US009773487B2

(12) United States Patent
Alt et al.

(10) Patent No.: US 9,773,487 B2
(45) Date of Patent: Sep. 26, 2017

(54) ONBOARD CAPACITIVE TOUCH CONTROL FOR AN INSTRUMENT TRANSDUCER

(71) Applicant: A LITTLE THUNDER, LLC, Los Angeles, CA (US)

(72) Inventors: Andrew J. Alt, Los Angeles, CA (US); Daniel B. Edney, Irvine, CA (US)

(73) Assignee: A LITTLE THUNDER, LLC, Los Angeles, CA (US)

( * ) Notice: Subject to any disclaimer, the term of this patent is extended or adjusted under 35 U.S.C. 154(b) by 0 days.

(21) Appl. No.: 15/002,145

(22) Filed: Jan. 20, 2016

(65) Prior Publication Data

US 2016/0210953 A1 Jul. 21, 2016

Related U.S. Application Data

(60) Provisional application No. 62/105,808, filed on Jan. 21, 2015.

(51) Int. Cl.
*G10H 3/18* (2006.01)
*G10H 1/055* (2006.01)

(52) U.S. Cl.
CPC ..... *G10H 3/181* (2013.01); *G10H 1/0551* (2013.01); *G10H 3/186* (2013.01); *G10H 2220/061* (2013.01); *G10H 2220/515* (2013.01)

(58) Field of Classification Search
CPC ..... G10H 3/181; G10H 3/186
USPC ..... 84/726
See application file for complete search history.

(56) References Cited

U.S. PATENT DOCUMENTS

| | | | |
|---|---|---|---|
| 2,897,709 | A | 8/1959 | McCarty et al. |
| 2,964,985 | A | 12/1960 | Webster |
| 2,976,755 | A | 3/1961 | Fender |
| 3,177,283 | A | 4/1965 | Fender |
| 3,249,677 | A | 5/1966 | Burns et al. |
| 3,290,980 | A | 12/1966 | Fender |
| 4,065,993 | A | 1/1978 | Hirose |
| 4,186,636 | A | 2/1980 | Roberts |
| 4,228,712 | A | 10/1980 | Uchiyama et al. |
| 4,295,402 | A | 10/1981 | Deutsch et al. |
| 4,328,732 | A | 5/1982 | Takeda et al. |
| 4,336,735 | A | 6/1982 | Amano et al. |
| 4,376,404 | A | 3/1983 | Haddad |
| 4,377,101 | A | 3/1983 | Santucci |
| 4,470,332 | A | 9/1984 | Aoki |

(Continued)

FOREIGN PATENT DOCUMENTS

FR 2684787 A1 * 6/1993 ..... G10H 3/181

*Primary Examiner* — David Warren
*Assistant Examiner* — Christina Schreiber
(74) *Attorney, Agent, or Firm* — Eckert Seamans Cherin & Mellott, LLC; Philip E. Levy

(57) ABSTRACT

A pickup unit for an electrical stringed instrument, such as an electric guitar, includes a housing structured to be connected to the stringed instrument and a number of pickups provided within the housing, each pickup being structured to produce signals corresponding to vibration of one or more strings of the stringed instrument. The pickup unit also includes a number of capacitive touch electrodes provided on or within the housing, wherein the pickup unit is structured to generate control signals in response to a user of the pickup unit touching one or more of the number of capacitive touch electrodes, the control signal being configured to control processing of the signals produced by the number of pickups.

20 Claims, 12 Drawing Sheets

(56) References Cited

U.S. PATENT DOCUMENTS 4,472,994 A 9/1984 Armstrong
4,481,854 A 11/1984 Dugas
4,483,233 A 11/1984 Benson
4,491,051 A * 1/1985 Barcus ..... G10H 3/143 84/728
4,495,847 A 1/1985 Deutsch et al.
4,907,483 A * 3/1990 Rose ..... G10H 3/18 84/726
5,189,241 A 2/1993 Nakamura
5,218,160 A 6/1993 Grob-Da Veiga
5,455,379 A 10/1995 Kim et al.
5,459,281 A 10/1995 Shibukawa
5,486,647 A 1/1996 Kay et al.
5,723,805 A 3/1998 Lacombe
5,796,025 A 8/1998 Haake
5,866,835 A * 2/1999 Baggs ..... G10H 3/181 84/731
5,880,391 A 3/1999 Westlund
5,932,827 A 8/1999 Osborne et al.
5,977,472 A 11/1999 Ito et al.
6,253,654 B1 * 7/2001 Mercurio ..... G10D 1/085 84/267
6,281,422 B1 8/2001 Kawamura
6,346,661 B1 2/2002 Yaskoweak
6,747,202 B2 6/2004 Kuroki
6,855,879 B2 2/2005 Minakuchi et al.
6,995,311 B2 2/2006 Stevenson
7,514,626 B1 * 4/2009 Snyder ..... G10H 3/181 84/723
7,582,824 B2 9/2009 Sumita
7,799,986 B2 9/2010 Ryle et al.
7,812,243 B2 10/2010 Celi et al.
8,093,482 B1 * 1/2012 Kramer ..... A63J 17/00 84/464 A
8,143,509 B1 3/2012 Robertson et al.
8,269,095 B1 * 9/2012 Wallace ..... G10H 3/143 84/726
8,476,519 B2 * 7/2013 Liotta ..... H04R 1/1033 2/90
8,502,061 B1 * 8/2013 Alt ..... G10H 1/32 84/725
9,000,287 B1 * 4/2015 Andersen ..... G10H 1/32 84/622
9,064,483 B2 * 6/2015 Alt ..... G10H 3/18
9,117,428 B2 * 8/2015 Ierymenko ..... G10D 3/04
2003/0106411 A1 6/2003 Minakuchi et al.
2004/0187673 A1 * 9/2004 Stevenson ..... G10H 1/02 84/737
2007/0227344 A1 10/2007 Ryle et al.
2008/0105101 A1 5/2008 Eldring
2008/0115656 A1 5/2008 Sumita
2009/0139390 A1 * 6/2009 Raisanen ..... G10H 1/055 84/737
2009/0223353 A1 9/2009 Loftus
2010/0224051 A1 9/2010 Kurebayashi
2010/0263521 A1 * 10/2010 Ierymenko ..... G10D 3/04 84/726
2010/0275761 A1 * 11/2010 Ierymenko ..... G10H 3/125 84/731
2011/0308378 A1 * 12/2011 Wallace ..... G10H 3/00 84/689
2012/0024129 A1 * 2/2012 Ball ..... G10H 1/18 84/602
2012/0036983 A1 * 2/2012 Ambrosino ..... G10H 3/143 84/731
2012/0125181 A1 5/2012 Loftus
2012/0144981 A1 * 6/2012 Ciccone ..... G10H 1/344 84/746
2013/0263721 A1 * 10/2013 Shavit ..... G10H 1/055 84/626
2014/0069264 A1 * 3/2014 Bialkowski ..... G10H 3/181 84/726
2014/0216235 A1 8/2014 Alt
2015/0059560 A1 * 3/2015 Perea Torres ..... G10H 1/32 84/726
2015/0317966 A1 * 11/2015 Liptac ..... G10H 1/32 84/735
2016/0210953 A1 * 7/2016 Alt ..... G10H 3/181

* cited by examiner

ONBOARD CAPACITIVE TOUCH CONTROL FOR AN INSTRUMENT TRANSDUCER

CROSS-REFERENCE TO RELATED APPLICATIONS

This application claims priority under 35 U.S.C. §119(e) from U.S. provisional patent application No. 62/105,808, entitled "Capacitive Touch to Control Signals Onboard an Instrument Transducer" and filed on Jan. 21, 2015, the contents of which are incorporated herein by reference.

BACKGROUND OF THE INVENTION

1. Field of the Invention

The present invention pertains to transducers for electrical stringed instruments, and, in particular, to a transducer, such as a pickup, for an electrical stringed instrument, such as an electrical guitar, that provides for capacitive touch to control the functionality and features of the transducer.

2. Description of the Related Art

Conventional stringed instruments have a limited audio range. For example, the conventional six string electric guitar has a limited tonal spectrum and is able to achieve sounds above the lowest open string (when tuned at standard "A 440 Hz" the lowest open string, "E"), which vibrates at 82.41 Hz when plucked.

In the case of conventional electric guitars, while there is typically some overlap in the audio ranges of a lead guitar and a bass guitar, the lead guitar cannot produce the range that the bass guitar can produce. Consequently, it is common for many types of bands or musical groups to include a musician who plays lead guitar, and a second musician who plays bass guitar.

It would thus be advantageous to have an electrical stringed instrument, such as an electric guitar, with an extended audio range that allows a single performer to produce audio in two or more ranges, preferably from the same string or strings. U.S. Pat. No. 8,502,061, entitled "Electrical Stringed Instrument and Signal Processing Circuit Therefor" and owned by the assignee hereof, the disclosure of which is incorporated herein by reference, describes such an instrument. More specifically, the '061 patent describes a guitar and a pick-up unit that is structured to implement a methodology for extending the range of an electrical stringed musical instrument (e.g., a conventional lead guitar) that employs first and second pickup circuits, wherein the first pickup circuit is associated with a first set of the strings of the instrument (e.g., all of the strings) and the second pickup circuit is associated with only a subset of the strings of the instrument (e.g., the low E and A strings). According to the methodology, the first pickup circuit is structured to produce a first electrical signal corresponding to a first audio range in response to vibration of one or more of the strings in the subset, and similarly the second pickup circuit is structured to produce a second electrical signal corresponding to the first audio range in response to vibration of the one or more of the strings in the subset. However, also according to the methodology, the second electrical signal is converted into a third electrical signal corresponding to a second audio range different than the first audio range (e.g., one octave lower) using a signal processor of the second pickup circuit. As a result, a user of the instrument is able to produce sounds in both the first audio range and the second audio range using the subset of strings, and may do so simultaneously. Thus, in the case where the instrument is a conventional lead guitar, the user may generate conventional lead guitar sounds and bass guitar sounds by strumming the subset of strings, and may do so simultaneously.

Furthermore, in the methodology described in the '061 patent, if multiple strings from the subset of strings (e.g., all of the strings in the subset) are played at the same time, the signal from each of those strings will be converted to the lower audio range and multiple bass notes will be resounded. This will often result in an undesirable muddy or muddled sound. In order to address this issue, U.S. Pat. No. 9,064,483, entitled "System And Method for Identifying and Converting Frequencies on Electrical Stringed Instruments" and owned by the assignee hereof, the disclosure of which is incorporated herein by reference, provides an enhancement of the system and methodology of the '061 patent that prevents muddled bass chords from resounding through an amplifier by giving the lowest analog note (often the "root") produced by the playing (strumming) of the strings from the subset of strings "priority" and only converting that note/signal to the lower audio range and subsequently outputting it through an amplifier (referred to herein as "low note priority"). In particular, the '483 patent describes a number of pick-up units that implement low note priority functionality that may be used in a guitar as described in the '061 patent.

While the methodologies just described have been proven to be quite advantageous and successful in the industry, there remains room for improvement in the field of electrical stringed instruments, and in particular in connection with electrical transducers, such as pickups, used therewith.

SUMMARY OF THE INVENTION

In one embodiment, a pickup unit for an electrical stringed instrument, such as an electric guitar, is provided. The pickup unit includes a housing structured to be connected to the stringed instrument and a number of pickups provided within the housing, each pickup being structured to produce signals corresponding to vibration of one or more strings of the stringed instrument. The pickup unit also includes a number of capacitive touch electrodes provided on or within the housing, wherein the pickup unit is structured to generate control signals in response to a user of the pickup unit touching one or more of the number of capacitive touch electrodes, the control signal being configured to control processing of the signals produced by the number of pickups.

In another embodiment, a method of controlling a pickup unit for an electrical stringed instrument is provided, wherein the pickup has a housing structured to be connected to the stringed instrument. The method includes receiving signals corresponding to vibration of one or more strings of the stringed instrument, the signal being produced by a number of pickups, generating control signals in response to a user of the pickup unit touching one or more of a number of capacitive touch electrodes provided on or within the housing, and controlling processing of the signals produced by the number of pickups based on the control signals.

DETAILED DESCRIPTION OF EXEMPLARY EMBODIMENTS

Figure 1:
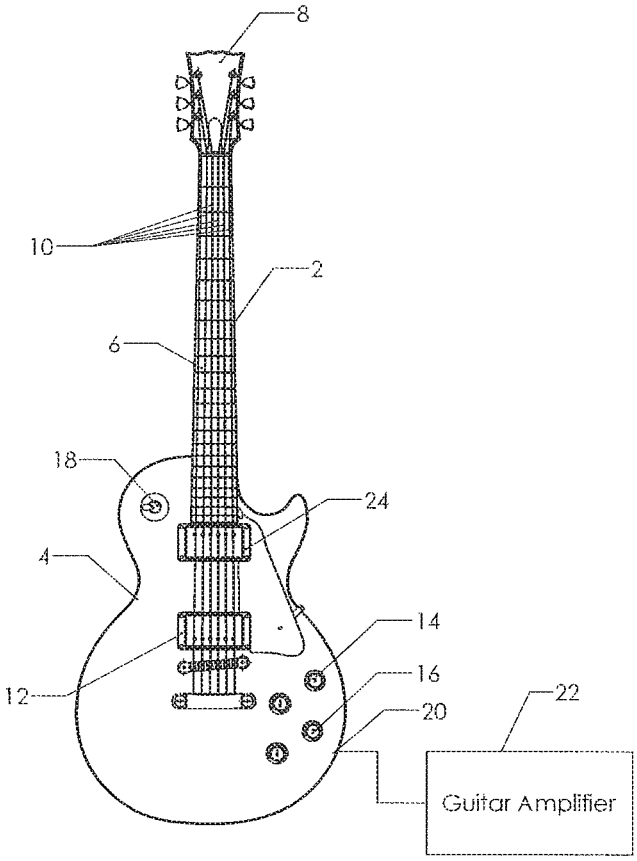
FIG. 1 is a schematic diagram of an electric guitar according to an exemplary embodiment of the disclosed concept.

As used herein, the singular form of "a", "an", and "the" include plural references unless the context clearly dictates otherwise.

As used herein, the statement that two or more parts or elements are "coupled" shall mean that the parts are joined or operate together either directly or indirectly, i.e., through one or more intermediate parts or elements, so long as a link occurs.

As used herein, "directly coupled" means that two elements are directly in contact with each other.

As used herein, "fixedly coupled" or "fixed" means that two elements are coupled so as to move as one while maintaining a constant orientation relative to each other.

As used herein, the word "unitary" means a part is created as a single piece or unit. That is, a part that includes pieces that are created separately and then coupled together as a unit is not a "unitary" part or body.

As employed herein, the statement that two or more parts or elements "engage" one another shall mean that the parts exert a force against one another either directly or through one or more intermediate parts or elements.

As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

Described herein is a method and apparatus to control functions and features for electrical stringed instruments through capacitive touch onboard a pickup that may be used as an enhancement to the apparatus and methodology of the '061 patent and/or the '483 patent, each of which is discussed above in the Background of the Invention. As described in greater detail herein, the method and apparatus of the disclosed concept allow for manipulation of sound by touching the transducer device itself, without a need to add external wires, knobs or switches to other areas in an electrical stringed instrument, such as a volume knob.

FIG. 1 is a schematic diagram of an electric guitar 2 according to an exemplary embodiment of the disclosed concept. As seen in FIG. 1, electric guitar 2 includes a body 4, a fret board 6, a head stock 8, a plurality (six in the illustrated embodiment) of strings 10, a conventional electromagnetic guitar pickup 12, a volume knob 14, a tone knob 16, a pickup selector switch 18, and an output jack 20. As seen in FIG. 1, output jack 20 is structured to enable electric guitar 2 (and in particular the pickup circuits thereof as described herein) to be connected to a guitar amplifier 22. In the exemplary embodiment, output jack 20 is a stereo jack that accepts a variety of cables and that is structured to output separate lead and bass guitar signals. Electric guitar 2 further includes a pickup unit 24 according to an exemplary embodiment of the disclosed concept. Pickup unit 24 is, in the non-limiting exemplary embodiment, structured to include both range extending functionality as described in the '061 patent (so that both lead and bass guitar sounds can be produced) and low note priority functionality as described in the '483 patent. As described in detail herein, pick-up unit 24 employs capacitive touch technology in order to control the range extending functionality and/or the low note priority functionality of pickup unit 24.

Figure 2:
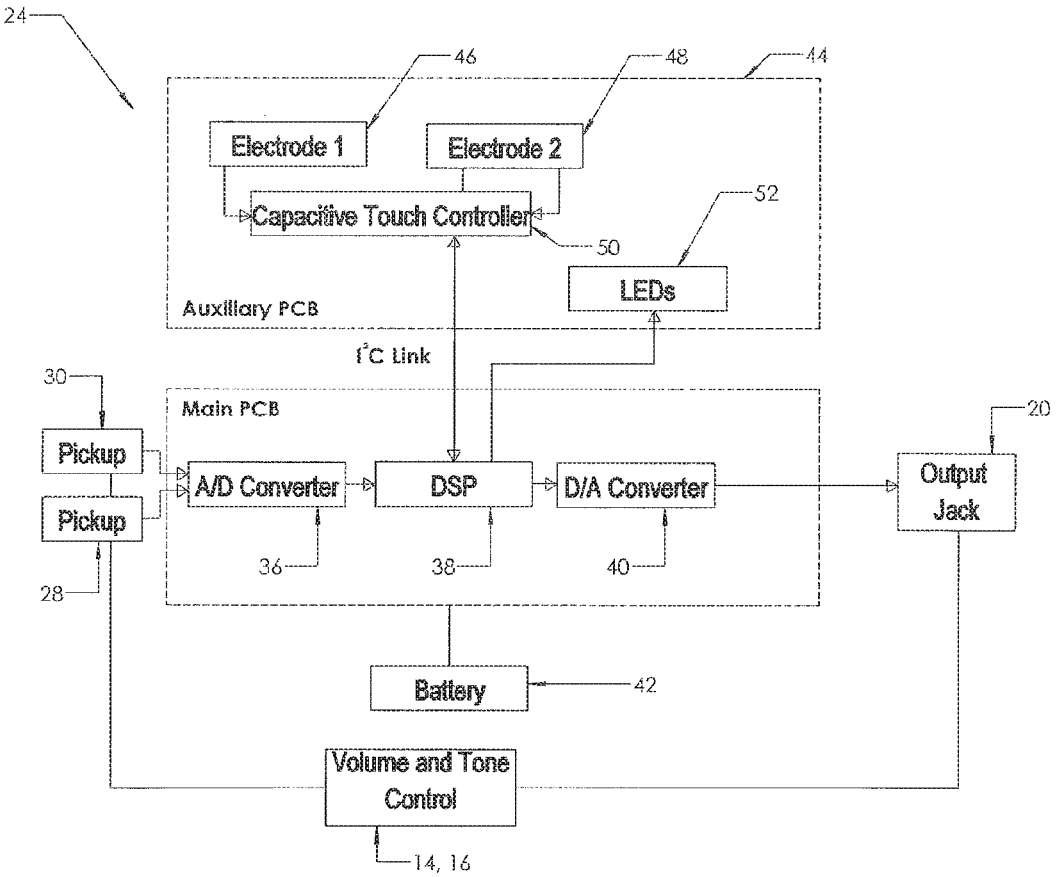
FIG. 2 is a top level block diagram of a pick-up unit according to one particular exemplary embodiment of the disclosed concept.
Figure 3:
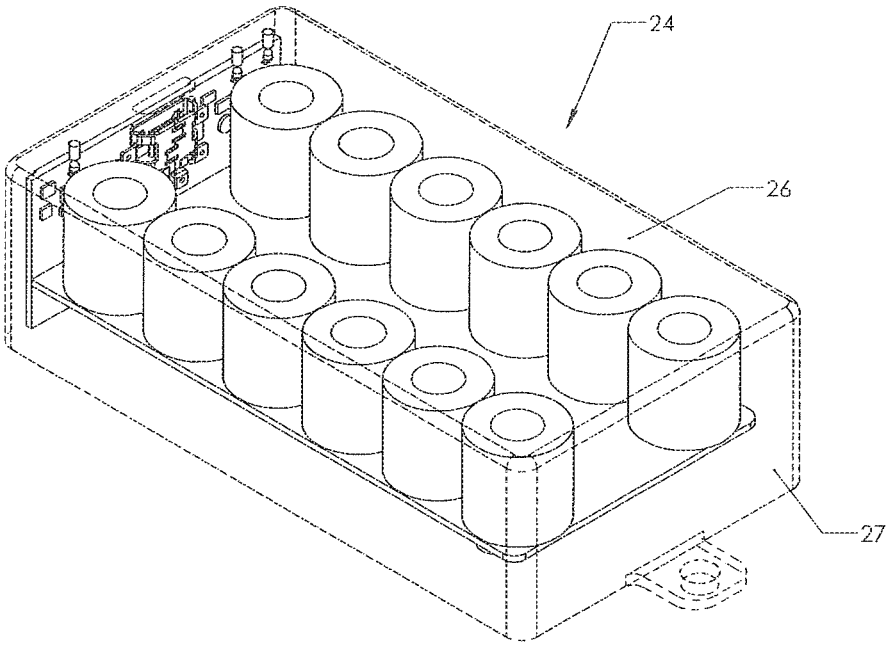
FIG. 3 is a front isometric view partially in phantom of the pick-up unit of FIG. 2 according to one particular exemplary embodiment of the disclosed concept.
Figure 4A:
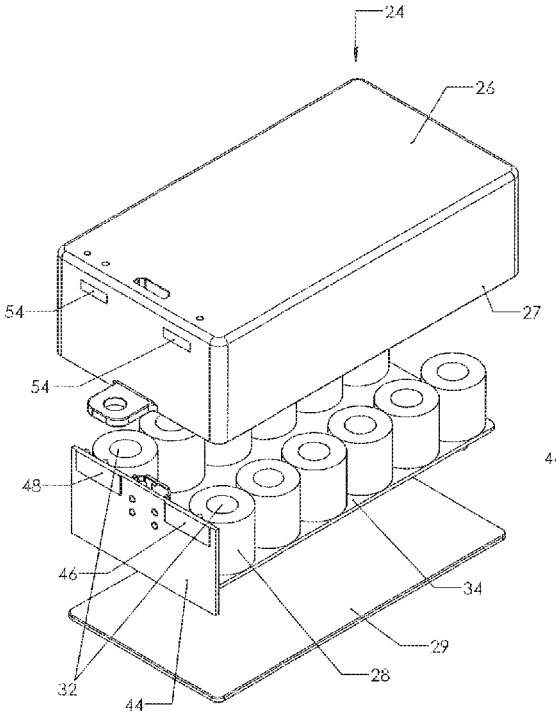
FIGS. 4A, 4B and 4C are top and bottom exploded views of the pick-up unit of FIG. 2 according to one particular exemplary embodiment of the disclosed concept.
Figure 4B:
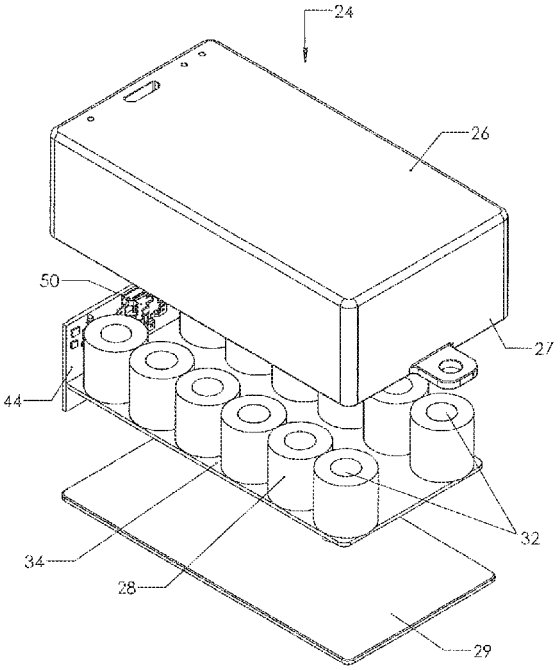
Figure 4C:
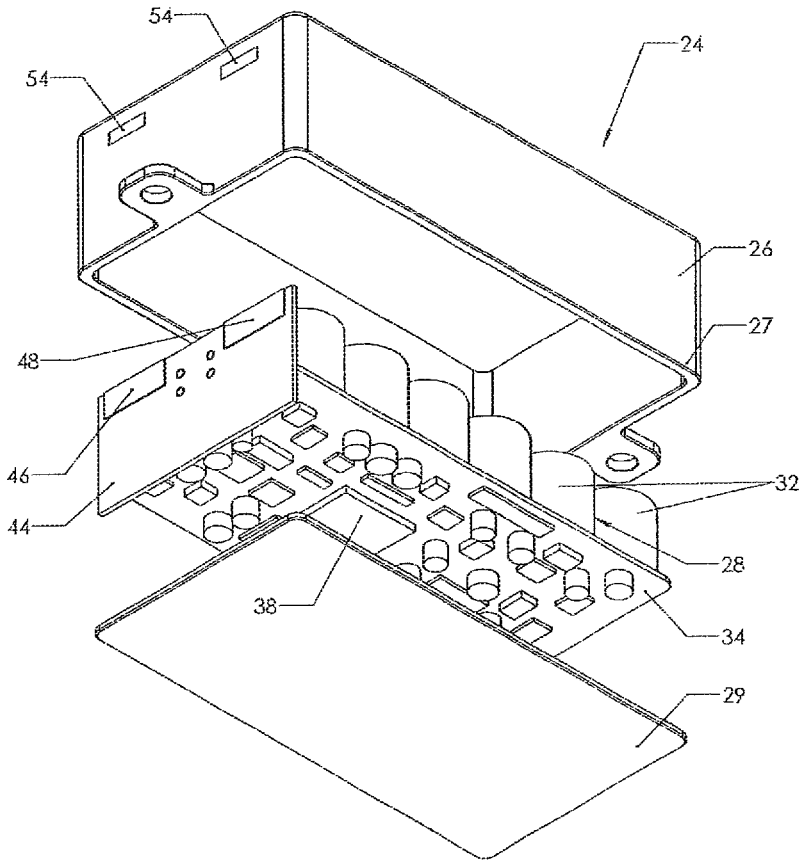
Figure 5:
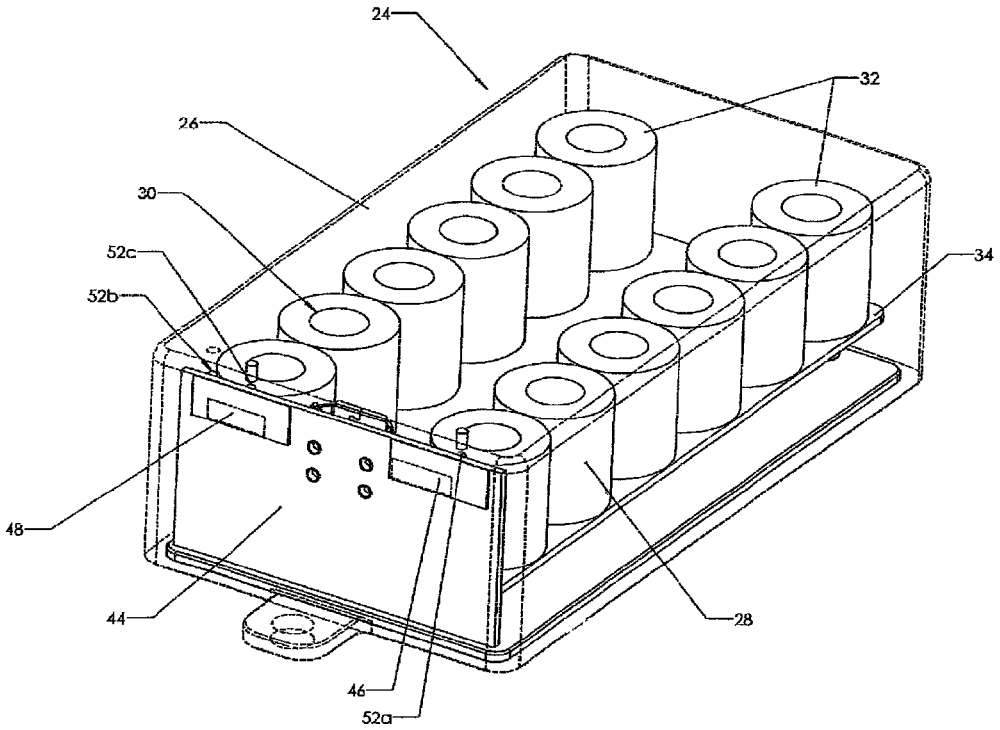
FIG. 5 is a front isometric view partially in phantom of the pick-up unit of FIG. 2 according to one particular exemplary embodiment of the disclosed concept
Figure 6:
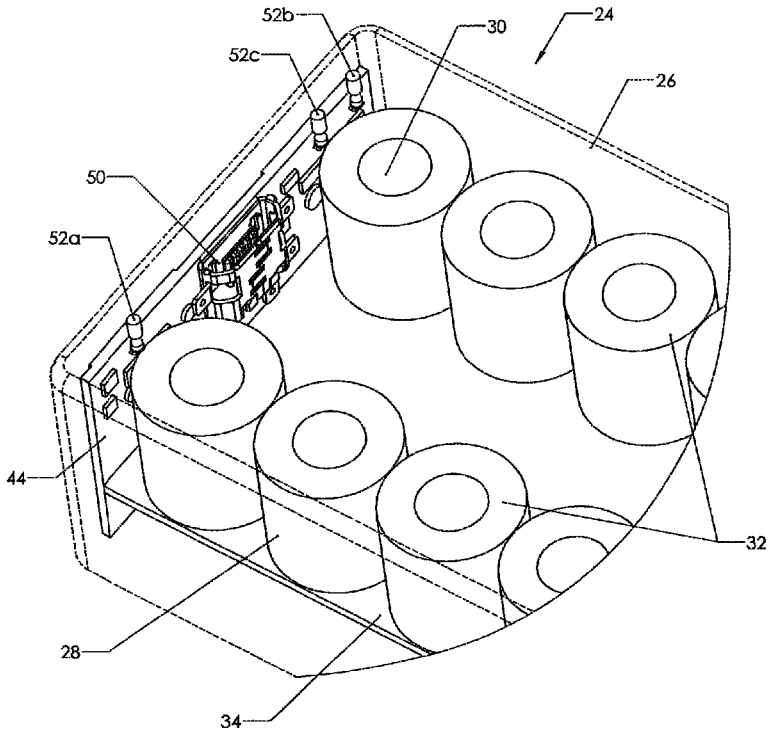
FIG. 6 is a partial top isometric view partially in phantom of the pick-up unit of FIG. 2 according to one particular exemplary embodiment of the disclosed concept.
Figure 7:
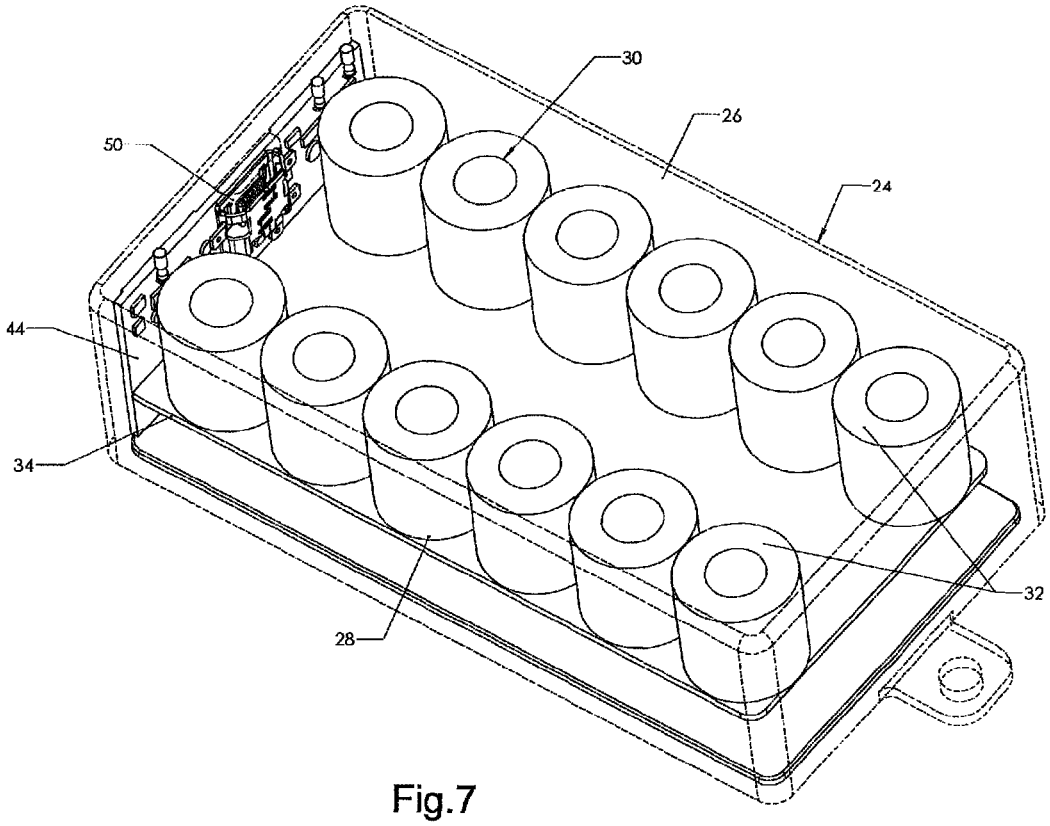
FIG. 7 is a top isometric view partially in phantom of the pick-up unit of FIG. 2 according to one particular exemplary embodiment of the disclosed concept.
Figure 8:
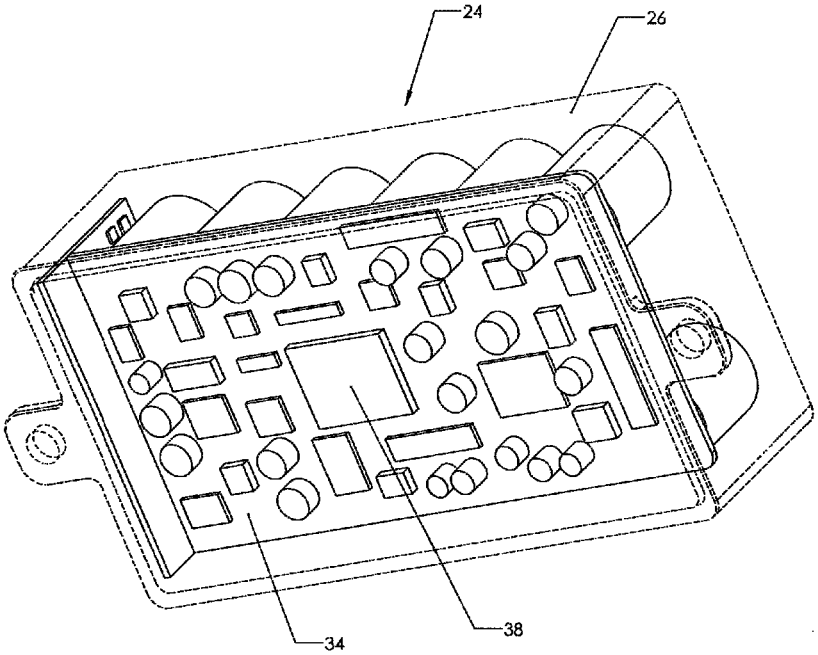
FIG. 8 is a bottom isometric view partially in phantom of the pick-up unit of FIG. 2 according to one particular exemplary embodiment of the disclosed concept.
Figure 9:
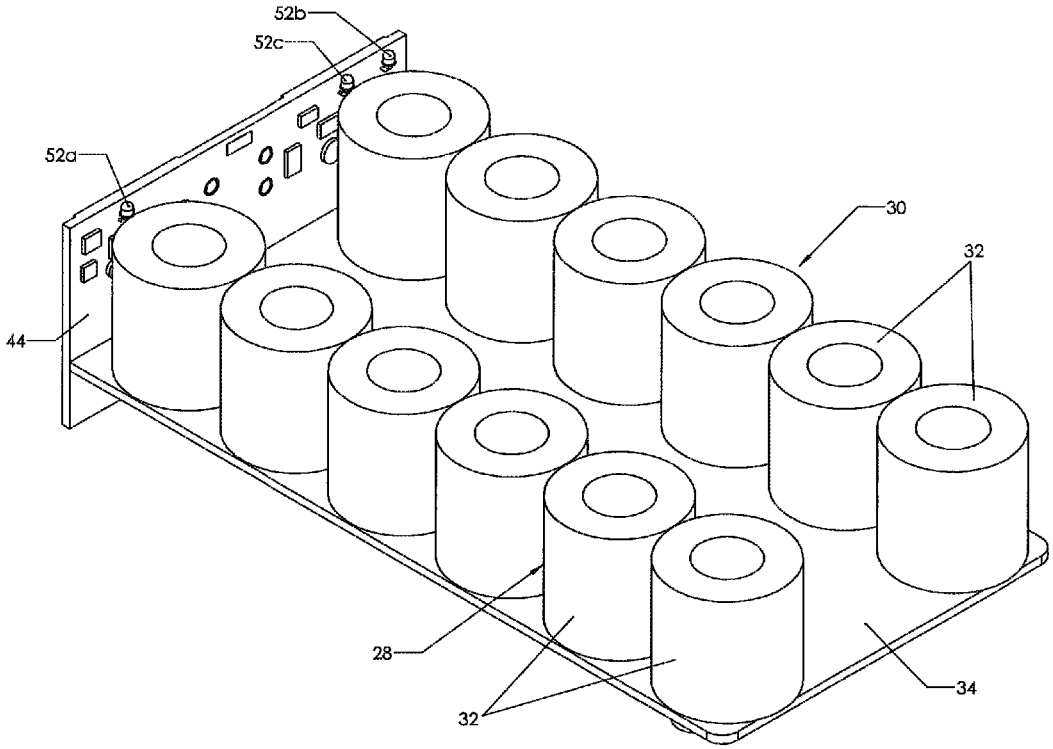
FIGS. 9 and 10 are top and bottom isometric views, respectively, of the pick-up unit of FIG. 2 according to one particular exemplary embodiment of the disclosed concept with the housing removed.
Figure 10:
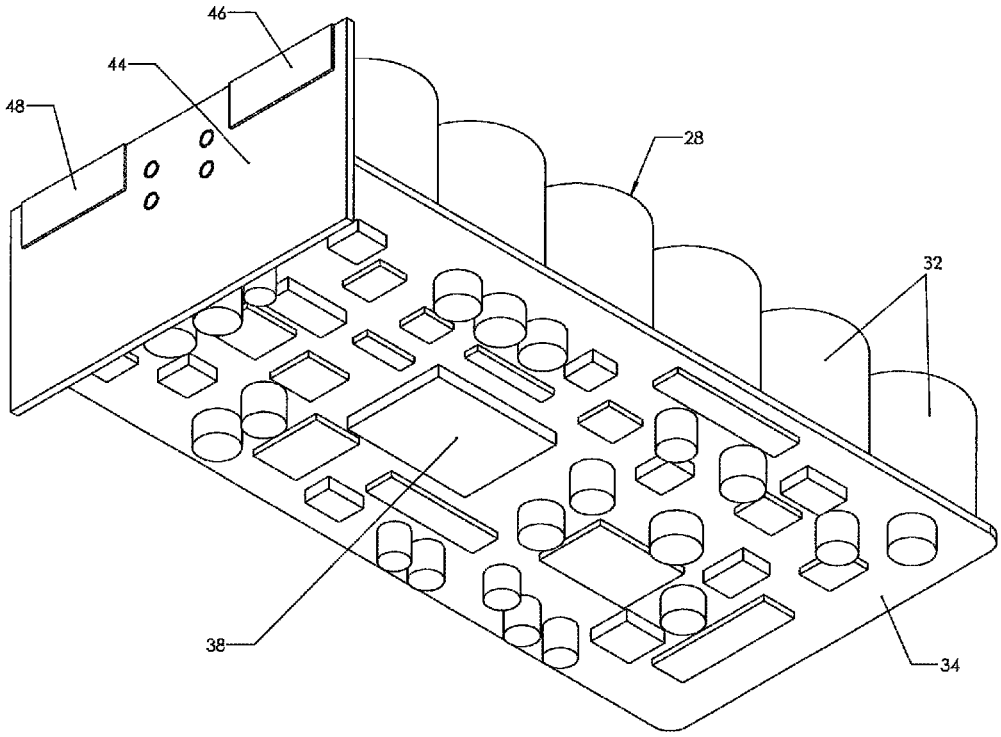

FIG. 2 is a top level block diagram of pick-up unit 24 according to one particular exemplary embodiment of the disclosed concept. and FIGS. 3, 4A, 4B, 4C, 5, 6, 7 and 8 are various views of pick-up unit 24 according to the exemplary embodiment. As seen in the FIGS. 3-8, pick-up unit 24 includes a main housing 26 (having a top member 27 and a bottom member 29) which houses the components of pick-up unit 24. Pick-up unit 24 includes pickups 28 and 30. Each pickup 28, 30 is a transducer that produce signals corresponding to the vibration of one or more of the strings 10 of guitar 2. In the exemplary embodiment, each pickup 28, 30 is conventional electromagnetic pickup that is commonly employed with electric guitars and other stringed instruments, and includes a number of (e.g., six) conventional magnetic pickup coils 32. Each pickups 28, 30 produces in the well-known and conventional manner analog electrical signals related to the frequencies of vibration of the strings 10 proximate the pickup 28, 30.

Pick-up unit 24 also includes a main printed circuit board (PCB) 34 which includes an analog-to-digital (A/D) converter 36, a digital signal processor (DSP) 38, a digital-to-analog (D/A) converter 40, and a rechargeable battery 42. DSP 38 is programmed to execute signal modifying algorithms as described herein and in the '061 patent and the '438 patent. Alternatively, DSP 38 may be replaced by any suitable signal processing device such as, without limitation, a general purpose microprocessor, a microcontroller, or an application specific integrated circuit (ASIC). In addition, pick-up unit 24 includes an auxiliary PCB 44 that provides the capacitive touch functionality described herein. In the exemplary embodiment, auxiliary PCB 44 includes a first capacitive touch electrode 46, a second capacitive touch electrode 48, a capacitive touch controller 50, and a number of LEDs 52 (or other suitable lighting elements).

In the illustrated exemplary embodiment, the capacitive touch electrodes 46 and 48 are embedded on the bottom surface of auxiliary PCB 44, which is inside main housing 26, which may be a conventional pickup cover made of plastic or metal, to detect human input and modify the sound accordingly. In the exemplary embodiment, auxiliary PCB 44 is connected to a main PCB 34 which, as described above, includes the embedded DSP 38 which is structured to modify signals generated by pickups 28, 30 to provide both range extending functionality and low note priority functionality. In particular, in the non-limiting exemplary embodiment, the range extending functionality is provided as described in the '061 patent and the low note priority functionality is provided as described in the '438 patent. Battery 42 housed inside main housing 26 powers the components of pickup unit 24 described herein.

In one particular, non-limiting exemplary embodiment, first and second capacitive touch electrodes 46 and 48 accept continuous auto-independent calibration for each electrode input and can delineate between an "intentional press" and an "accidental press", such as one from a palm resting near strings 10. For example, capacitive touch input is measured in picofarad (pf) value. Software running on DSP 38 that is in communication with capacitive touch electrodes 46 and 48 through capacitive touch controller 50 can set thresholds for what can be considered an accidental press, such as, without limitation, a detected press for a shorter contact time (below some predetermined time) with less pf value (below some predetermined threshold level, e.g., measured in milliseconds). Therefore, a guitar player strumming and lightly brushing over one of the capacitive touch electrodes 46, 48 will not engage the DSP effect through capacitive touch, where an intentional press with greater measured pf value and increased time touching one of the capacitive touch electrodes 46, 48 will fully engage the DSP.

As described in greater detail herein, LEDs 52 housed inside main housing 26 function as small indicator lights which function to let the user know which DSP "mode" pickup unit 24 is in. LEDs 52 also reflect when input to the capacitive touch controls is received.

In the exemplary embodiment, DSP 38 communicates with capacitive touch controller 50 using the $I^2C$ protocol. Two way communications are provided to enable DSP 38 to get touch status information from capacitive touch controller 50 (which monitors electrodes 46 and 48 in a known manner and indicates, among other things, which electrode 46, 48 is being touched at any particular time) and to set the sensitivity of capacitive touch controller 50. DSP 38 sets the capacitive touch sensitivity to be less sensitive, if needed, before main PCB 34 is powered off to recall the user's specific touch pf "preferences.". The connection to main PCB 34 is configured such that activity from capacitive touch controller 50 (based on a user touching one or more of electrodes 46, 48) will cause main PCB 34 to power up when it is in a powered down state. DSP 38 reads the touch status from capacitive touch controller 50, and in some embodiments can further apply a time delay and de-bouncing to ensure that only intentional touches of electrodes 46, 48 are treated as button presses. For example, a fast double press may trigger a specific mode of DSP 38 whereas as a single long press will serve a different function.

Also in the exemplary embodiment, main PCB 34 acts as a structural support (i.e., a baseplate) for supporting the pickups 28 and 30. In addition, as seen in FIGS. 3-8 and FIGS. 9 and 10 (which omit housing 26 for ease of illustration), the main plane of the surface (e.g., bottom surface) of main PCB 34 is parallel to a bottom wall of main housing 26, and auxiliary PCB 44 is connected sideways with respect to the main plane of the surface (e.g., bottom surface) of auxiliary PCB 44 (i.e., the main plane of the surface (e.g., bottom surface) of main PCB 34 is normal (i.e., perpendicular) to the main plane of the surface (e.g., bottom surface) of auxiliary PCB 44). All of the components of pick-up unit 24 are potted into main housing 26, which is a normal sized humbucker enclosure, using a suitable potting compound such as RTV silicone or epoxy resin. Auxiliary PCB 44 is positioned as shown (pressed against one of the lateral side walls of main housing 26 normal (i.e., perpendicular) to the main plane of the surface of main PCB 34 and normal (i.e., perpendicular) to the bottom wall of main housing 26) so that the side wall can be easily touched by a user to engage and activate the electrodes 46, 48 (through the material of main housing 26) when pick-up unit 24 installed and guitar 2 is being played. In this configuration, auxiliary PCB 44 does not get in the way of the coils 32 of pickups 28 and 30. In the exemplary embodiment, small indents 54 (e.g., 0.2 mm deep) are provided on the exterior surface of the lateral side wall of main housing 26 in alignment with the electrodes 46, 48 to make the position of electrodes 48, 48 easier to identify (i.e., by feel).

Figure 11:
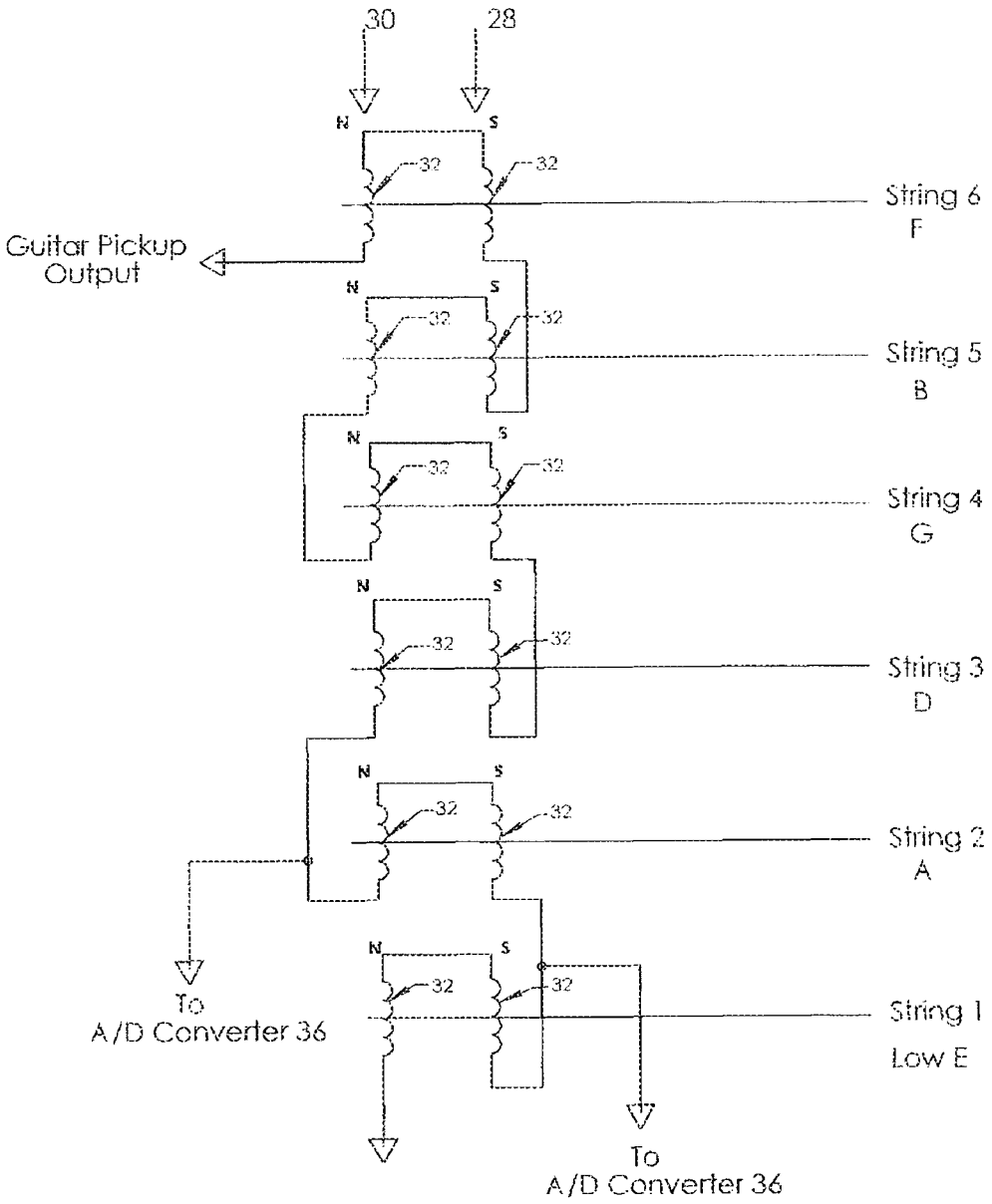
FIG. 11 is a circuit diagram showing the pickups of the pick-up unit of FIG. 2 according to one particular exemplary embodiment of the disclosed concept.

In the exemplary embodiment, each pickup 28, 30 includes six individual coils 32 such that pick-up unit 24 as a whole includes twelve individual coils 32 to make a polyphonic humbucker. As illustrated in FIG. 11, all twelve coils 32 are connected in series to make a monophonic standard output (see "Guitar Pickup Output") which is provided to output jack 20, and two coils 32 from each pickup 28, 30 (the coils 32 positioned under the low E and A strings) are provided as inputs to A/D converter 36 so that the signals generated therefrom may be shifted in frequency as described in the '061 patent. Each adjacent pair of coils 32 (one from pickup 28 and one from pickup 30) is arranged as a humbucker (i.e., by pairing a coil 32 with the north poles of its magnets oriented "up" (toward strings 10) with a coil 32 with the south poles of its magnets oriented "up" (toward strings 10)).

In the non-limiting exemplary embodiment, control of the functionality of pick-up unit 24 is as follows. The first touch of capacitive touch electrode 46 will cause DSP 38 to enter the mode wherein received signals are shifted down one octave (−1 octave), the second touch of capacitive touch electrode 38 will cause DSP 38 to enter the mode wherein received signals are shifted down two octaves (−2 octaves), and the third touch of capacitive touch electrode 46 will cause DSP 38 to disable (i.e., turn off) the frequency shifting functionality. This cycle of three touches may then be repeated as desired. In addition, a first LED 52*a* is structured to indicate the current status of the frequency shifting functionality. In particular, first LED 52*a* will be off when the frequency shifting functionality is deactivated, first LED 52*a* will be a first color when the frequency shifting is set to one octave, and first LED 52*a* will be a second color with the frequency shifting is set to two octaves. Capacitive touch electrode 48 is used to control whether the low note priority functionality is activated. In particular, the default state when the frequency shifting functionality is activated is for the low note priority functionality to be off. The low note priority functionality may then be toggled on and off by touching capacitive touch electrode 48. A second LED 52*b* is toggled on and off to indicate the status of the low note priority functionality. A third LED 52*c* is used to indicate the status of rechargeable battery 42. In particular, third LED 52*c* will be a first color when rechargeable battery 42 is being charged, and will be a second color when charging is complete.

In still further embodiments, capacitive touch may be used to control volume and other primary functions of a transducer such as pickup unit 24 of an electrical stringed instrument such as guitar 2 in order to make it easier for the common consumer to install the transducer as there would only be one connection to be made at the instrument's output jack and there would be no requirement to solder and wire to a volume knob. Such capacitive touch functionality along the side of the transducer can allow for the volume tapered between off and a maximum volume (with infinite settings in-between).

Thus, the configuration of the disclosed concept enables the control of functions and features, such as frequency shifting and low note priority functionality, for electric instrument signals through capacitive touch provided onboard a pickup. The configuration is advantageous as it eliminates physical buttons, switches and knobs, where housing such elements on a humbug or pickup itself, which has limited space and clearance issues, would be impractical/impossible. Capacitive touch also allows for multiple assignments and touch combinations for users to access different DSP effects through software assignment.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A pickup unit for an electrical stringed instrument, comprising:

a housing structured to be connected to the stringed instrument;

a number of pickups provided within the housing, each pickup being structured to produce signals corresponding to vibration of one or more strings of the stringed instrument; and a number of capacitive touch electrodes provided on or within the housing, wherein the pickup unit is structured to generate control signals in response to a user of the pickup unit touching one or more of the number of capacitive touch electrodes, the control signal being configured to control processing of the signals produced by the number of pickups.

2. The pickup unit according to claim 1, further comprising a signal processing device provided within the housing, the signal processing device being coupled to the number of pickups and structured to receive the signals produced by the number of pickups, wherein functionality of the signal processing device is structured to be controlled responsive to the control signals.

3. The pickup unit according to claim 2, further comprising a first printed circuit board and a second printed circuit board provided within the housing, wherein the signal processing device is provided on the first printed circuit board, wherein a controller is provided on the second printed circuit board, wherein each of the number of capacitive touch electrodes is coupled to the controller, and wherein the controller is structured to generate the control signals.

4. The pickup unit according to claim 3, wherein the housing includes a bottom wall and a side wall perpendicular to the bottom wall, wherein a first surface of the first printed circuit board is parallel to the bottom wall and wherein a first surface of the second printed circuit board is parallel to the side wall, wherein each of the number of capacitive touch electrodes is provided on the first surface of the second printed circuit board such that each of the number of capacitive touch electrodes may be activated through the side wall of the housing.

5. The pickup unit according to claim 4, wherein each of the number of pickups is supported on the first surface of the first printed circuit board, and the signal processing device is provided on a second surface of the first printed circuit board opposite the first surface of the first printed circuit board.

6. The pickup unit according to claim 4, wherein the controller is provided on a second surface of the second printed circuit board opposite the first surface of the second printed circuit board.

7. The pickup unit according to claim 2, wherein the number of pickups includes a first electromagnetic pickup having a plurality of first coils and a second electromagnetic pickup having a plurality of second coils.

8. The pickup unit according to claim 7, wherein the first electromagnetic pickup has six first coils having first poles and the second electromagnetic pickup has six second coils having second poles, and wherein the first electromagnetic pickup and the second electromagnetic pickup together form a polyphonic humbucker with the first poles and the second poles oriented in opposite directions.

9. The pickup unit according to claim 8, wherein the first coils and the second coils are all connected in series to form a monophonic standard output, wherein a first one of the first coils and a first one of the second coils adjacent the first one of the first coils are coupled to the signal processing device to provide for a first input to the signal processing device and a second one of the first coils and a second one of the second coils adjacent the second one of the first coils are coupled to the signal processing device to provide for a second input to the signal processing device.

10. The pickup unit according to claim 9, wherein the first one of the first coils and the first one of the second coils are coupled to the signal processing device through an analog-to-digital converter such that the first input is a first digital signal, and the second one of the first coils and the second one of the second coils are coupled to the signal processing device through the analog-2-digital converter such that the second input is a second digital signal, and wherein the signal processing device is structured to shift a frequency of either or both of the first digital signal and the second digital signal.

11. The pickup unit according to claim 2, wherein the number of capacitive touch electrodes includes a first capacitive touch electrode, wherein the signal processing device is structured and programmed to provide range extending functionality wherein one or more signals generated using the number of pickups are shifted in frequency, and wherein the signal processing device is structured to enable control of the range extending functionality based on a first one or more of the control signals generated in response to the user of the pickup unit touching the first capacitive touch electrode.

12. The pickup unit according to claim 11, wherein the signal processing device is structured to cause the range extending functionality to be in a −1 octave mode responsive to a first touch of the first capacitive touch electrode, be in a −2 octave mode responsive to a second touch of the first capacitive touch electrode, and be in an off mode responsive to a third touch of the first capacitive touch electrode.

13. The pickup unit according to claim 11, wherein the number of capacitive touch electrodes includes a second capacitive touch electrode, wherein the signal processing device is structured and programmed to provide low note priority functionality wherein only one of the signals generated using the number of pickups is shifted in frequency, and wherein the signal processing device is structured to enable control of the low note functionality based on a second one or more of the control signals generated in response to the user of the pickup unit touching the second capacitive touch electrode.

14. The pickup unit according to claim 13, wherein the signal processing device is structured to cause the low note priority functionality to be in an on mode responsive to a first touch of the second capacitive touch electrode, and be in an off mode responsive to a second touch of the second capacitive touch electrode.

15. The pickup unit according to claim 13, further comprising a number of lighting elements provided on or within the housing, the number of lighting elements being controlled by the signal processing device and being structured to signal a current operating mode of the pickup unit to a user of the pickup unit.

16. The pickup unit according to claim 2, wherein the signal processing device is a digital signal processor.

17. An electrical stringed instrument including a pickup unit according to claim 1.

18. A method of controlling a pickup unit for an electrical stringed instrument, the pickup unit having a housing structured to be connected to the stringed instrument, comprising:

receiving signals corresponding to vibration of one or more strings of the stringed instrument, the signal being produced by a number of pickups provided within the housing;

generating control signals in response to a user of the pickup unit touching one or more of a number of capacitive touch electrodes provided on or within the housing; and controlling processing of the signals produced by the number of pickups based on the control signals.

19. The method according to claim 18, wherein the number of capacitive touch electrodes includes a first capacitive touch electrode, wherein the controlling processing of the signals comprises controlling range extending functionality based on a first one or more of the control signals generated in response to the user of the pickup unit touching the first capacitive touch electrode, wherein when the range extending functionality is enabled one or more signals generated using the number of pickups are shifted in frequency.

20. The method according to claim 19, wherein the number of capacitive touch electrodes includes a second capacitive touch electrode, wherein the controlling processing of the signals further comprises controlling low note priority functionality wherein only one of the signals generated using the number of pickups is shifted in frequency based on a second one or more of the control signals generated in response to the user of the pickup unit touching the second capacitive touch electrode.

* * * * *